US008091297B2

(12) United States Patent
Tiberi et al.

(10) Patent No.: US 8,091,297 B2
(45) Date of Patent: Jan. 10, 2012

(54) BUILDING CONSTRUCTION ELEMENT

(75) Inventors: Sylvain Tiberi, Laval (CA); Michel Mathon, Repentigny (CA)

(73) Assignee: Thermo Structure Inc., Mascoudie, Quebec (CA)

( * ) Notice: Subject to any disclaimer, the term of this patent is extended or adjusted under 35 U.S.C. 154(b) by 0 days.

(21) Appl. No.: 12/588,628

(22) Filed: Oct. 22, 2009

(65) Prior Publication Data

US 2010/0037542 A1 Feb. 18, 2010

Related U.S. Application Data

(63) Continuation-in-part of application No. 11/104,537, filed on Apr. 13, 2005, now abandoned.

(51) Int. Cl.
*E04C 3/02* (2006.01)
*E04B 9/00* (2006.01)

(52) U.S. Cl. ..... 52/204.2; 52/474; 52/481.1; 52/211

(58) Field of Classification Search ..... None
See application file for complete search history.

(56) References Cited

U.S. PATENT DOCUMENTS

| | | | | |
|---|---|---|---|---|
| 4,601,144 | A | 7/1986 | Tinti | |
| 4,852,322 | A | 8/1989 | McDermid | |
| 4,937,122 | A | 6/1990 | Talbert | |
| 5,497,595 | A * | 3/1996 | Kalinin | 52/836 |
| 5,653,080 | A | 8/1997 | Bergeron | |
| 5,678,381 | A | 10/1997 | DenAdel | |
| 5,966,894 | A | 10/1999 | Crump, Jr. | |
| 6,438,916 | B1 | 8/2002 | Ueki | |
| 6,481,172 | B1 | 11/2002 | Porter | |
| 6,772,572 | B2 | 8/2004 | Henthorn | |
| 2005/0055973 | A1 | 3/2005 | Hagen, Jr. et al. | |

* cited by examiner

*Primary Examiner* — Eileen D Lillis
*Assistant Examiner* — Mark Wendell
(74) *Attorney, Agent, or Firm* — Equinox Protection; Franz Bonsang

(57) ABSTRACT

A building construction frame element consists of a wooden core of a single piece of wooden material provided with a thermal break formed of an insulating material extending across the heat conductance path of the element, which may be in the form of stud for a wall or ceiling. A method for producing the frame element is also disclosed.

9 Claims, 2 Drawing Sheets

BUILDING CONSTRUCTION ELEMENT

CROSS REFERENCE TO RELATED APPLICATIONS

The present application is a continuation-in-part (C.I.P.) of patent application Ser. No. 11/104,537, filed on Apr. 13, 2005, now abandoned.

FIELD OF THE INVENTION

The present invention has general reference to a building construction frame element and in particular concerns a wooden frame element used in a building framework and method of manufacture thereof. The wooden frame element may be in the form of a vertical stud, a lintel, window sill or the like deployed in the framework structure, for example a wall or ceiling structure.

BACKGROUND ART

It is well known in the art to create a building framework composed of wooden elements and to provide thermal insulation within the framework usually contained between those elements and facing panels suitably secured thereto to form walls defining the areas required within the building. One such wooden element is disclosed in U.S. Pat. No. 4,937,122 and is formed by bonding a pair of wooden planks to an intermediate expanded foam layer to form a composite assembly. That assembly may subsequently be divided into a number of individual elements for use in a prefabricated panel assembly in the construction of the walls and ceilings of a building. In certain territories such as Canada and the United States such elements are not approved and are not used in load-bearing walls.

Another example of a wooden element is described in U.S. Pat. No. 6,481,172 is an insulated spline comprising two outer wooden studs with an insulating core sandwiched therebetween. This type of element is similarly deficient in that it does not have approval for use in load-bearing walls.

In structures of the type indicated the problem of thermal bridging is prevalent in that the stud constitutes a path for heat flow conductance in the building envelope, thus diminishing the overall insulative properties of the structures and in addition can give rise to condensation on the relatively cold (or hot) spots occasioned by the thermal bridging.

SUMMARY OF THE INVENTION

It is an object of the present invention to provide an improved building construction frame element, which includes a thermal break thus affording at least one thermally insulative boundary, and method of manufacture thereof.

It is a further object of the invention to provide such a building construction frame element of relatively simple manufacture and an element suitable for load-bearing wall construction.

Accordingly the invention provides a building construction frame element comprising a wooden core, the wooden core being a single piece of wooden material having two relatively longer sides and two relatively shorter sides extending therebetween, and at least one thermal break constituted by a heat insulating material formed in a layer affixed to the wooden core and transversely extending at least partially and substantially thereacross from a respective first extremity of one longer side towards a respective second extremity of the other longer side, the at least one thermal break providing a barrier extending completely across a heat conductance path of the wooden core extending longitudinally through the wooden core from one shorter side to the other shorter side and blocking passage of heat therebetween, the wooden core being a structural member of the frame element.

The thermal break is advantageously constituted by a heat insulating material conveniently formed in a layer affixed or bonded to a face of the wooden core thus providing a thermal barrier against heat conductance across and through the core.

One or more such thermal breaks may be provided and thus for example in the case of a construction frame element in the form of a stud, thermal breaks may be provided on those opposed faces which are the boundaries across which thermal bridging would otherwise occur. In this instance, the building construction frame element would be of essentially laminated form with a wooden core having two outer layers of heat insulating material to give symmetry to the element. For example, two-by-four or two-by-six studs would have the outer layers bonded to the shorter sides. The invention also provides for the disposition of a lath for covering the or each layer of heat insulating material for the purpose of providing a base for fixtures in use securing facing panels.

In an alternative expression of the invention the wooden core of the construction frame element may be a wooden stud having at least one suitably formed channel extending across a heat conductive path or thermal bridge and along a full length of the stud. The channel penetrates substantially transversely across the stud to an extent that the channel forms a thermal break, a heat insulating material being provided in the channel.

Typically, the channels are formed in opposite sides of the stud and typically overlap, as necessary, to provide a thermal break as required with the heat insulating material in the channels. The channels may be formed at any suitable location to ensure that a full thermal break is achieved in practice. The depth of the channels may be of the same dimension sufficient to ensure an overlap. However, in another embodiment, the depth of one channel may differ from that of the other channel, but still preferably providing an overlap to ensure a full thermal break, and accordingly the channels would be asymmetric. The heat insulating material may be injected and bonded into the channels.

The heat insulating material may be of any suitable type approved for use in the construction of buildings, for example foamable plastics polymer.

The terms 'wooden' and 'wood' as used herein are intended to include solid wood, laminated wood such as plywood, or fiberboard, medium dense fiberboard (MDF), chipboard or any equivalent composite wooden product.

It is to be understood that whilst the invention has been described in relation to a stud, it is equally applicable to other building construction frame elements across which thermal bridging could otherwise occur, for example, lintels, window sills or the like and the term 'stud' is to be construed accordingly.

The invention also encompasses a building wall frame structure embodying one element or a plurality of frame elements as defined herein.

According to another aspect of the present invention, there is provided a method for producing a building construction frame element having a wooden core, the wooden core being a single piece of wooden material having two generally longer sides and two generally shorter sides and being a structural member of the frame element, the method comprises the step of: disposing at least one thermal break constituted by a heat insulating material formed in a layer affixed to the wooden core at least partially and substantially thereacross from a respective first extremity of one longer side towards a respective second extremity of the other longer side to provide a barrier extending completely across a heat conductance path of the wooden core extending longitudinally through the wooden core from one shorter side to the other shorter side and blocking passage of heat therebetween, the wooden core being a structural member of the frame element.

Typically, the step of disposing at least one thermal break includes the steps of: bonding at lest one layer of heat insulating material onto the wooden core; and providing the insulating layer with a covering wooden lath.

Alternatively, the wooden core is of a generally rectangular cross section having two relatively shorter sides and two relatively longer sides, the step of disposing at least one thermal break includes the steps of: forming a channel in at least one of the longer sides, the channel extending a full length of the frame element and penetrating substantially transversely thereacross to an extent that the channel forms a thermal break; and providing a heat insulating material in the channel.

BRIEF DESCRIPTION OF THE DRAWINGS

Reference will now be made to the accompanying drawings, showing by way of illustration, a preferred embodiment thereof, and in which.

Like numerals of reference have been used in the drawings to denote like parts.

DETAILED DESCRIPTION OF THE PREFERRED EMBODIMENTS

Figure 1:
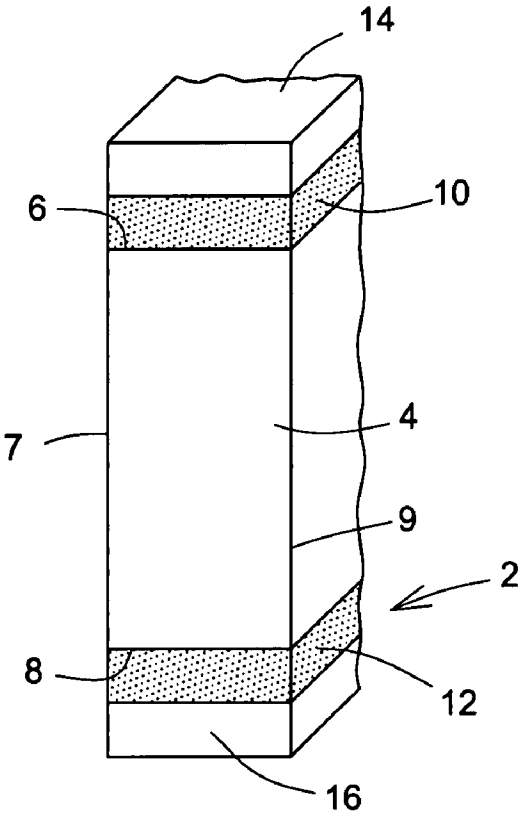
FIG. 1 is a diagrammatic sectional view of a building construction frame element according to a first embodiment of the invention and taken along line 1-1 of FIG. 4.

Referring first to FIG. 1 there is shown a building construction frame element in this example in the form of a vertical stud 2 comprising a solid wooden core 4 being a single piece of wooden material such as of a notional two-by-four member. On each of the two relatively shorter sides 6, 8 of the cross-section there is affixed, by bonding, injecting or the like method, a thermal insulating layer 10, 12 forming a thermal break, which provides a barrier against heat conductance, namely thermal bridging, through the stud 2, in the direction of the two longer sides 7, 9 of the cross-section between the two shorter sides 6, 8. For the purpose of providing a suitable holding for fixtures such as nails, screws and the like, laths 14, 16 of appropriate thickness are bonded or otherwise secured to the layers 10, 12 respectively. All components of the stud 2, i.e. the core 4, the layers 10, 12, and the laths 14, 16, extend along the entire length of the stud 2. The stud 2 has substantially the overall cross-sectional size of a notional two-by-six member.

In practice, a framework of studs 2 (sometimes structural members) and noggins (not shown) would be constructed with thermal insulation provided between the relatively longer sides 7, 9 of consecutive studs and facing panels of plasterboard for example would be affixed, e.g. by nailing, to the laths 14, 16. The laths may be wooden or may be of a composite material containing wood as a principal component or in laminate or comminuted form. The whole assembly of the framework (see FIG. 4) and the panels thus present a comprehensive thermally insulated structure that is not compromised by the thermal bridging normally associated with conventional assemblies of this kind.

Figure 2:
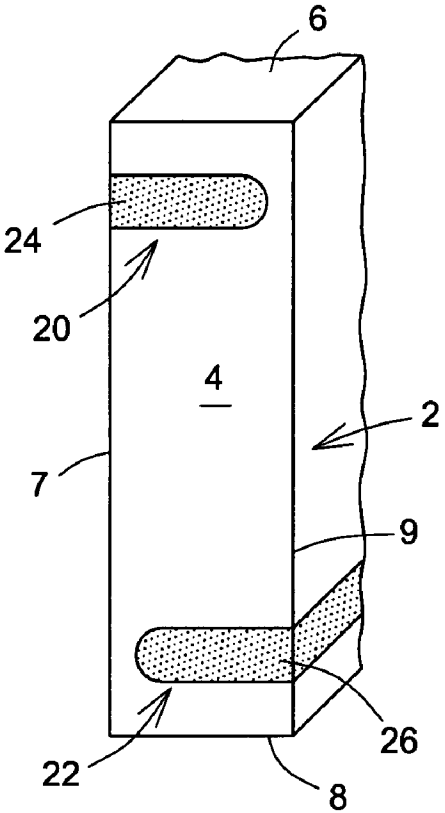
FIG. 2 is a diagrammatic sectional view of a building construction frame element according to a second embodiment of the invention.

Referring now to FIG. 2, a stud 2 has a rectangularly cross sectioned wooden core 4 being a single piece of wooden material of notional two-by-six dimensions having two shorter sides 6, 8 and two longer sides 7, 9 of the cross-section. Each of the longer sides 7, 9 has formed close to but spaced from its respective shorter sides 6, 8 a channel 20, 22 extending substantially the whole length of the stud 2, the channels being filled with preferably injected insulating material indicated at 24, 26 respectively. As will be observed the channels 20, 22 extend partially substantially across the thickness of the stud but their dimension is such that they typically overlap for the purpose of completing a thermal break across the whole thickness of the stud to prevent heat conductance there through. The shorter sides 6, 8 maintain solid wood for the reception of fixtures as aforesaid without the need for additional laths, and thus the structural integrity and behavior of the stud are not compromised. In this particular embodiment the lateral dimensions of the transverse channels 20, 22 are the same and thus present a symmetrical formation. However, in a variation of this embodiment (not shown) the lateral dimensions of the channels 20, 22 may differ whilst preferably maintaining an overlap to preserve the integrity of the thermal break. Such an arrangement thus presents an asymmetric formation. In such an embodiment, the unaltered portion of the wooden core 4 between the two channels 20, 22, can easily be of a size similar to the notional two-by-four stud such that the stud 2 remains structurally approved for use in load-bearing walls.

Although channels 20, 22 are shown as overlapping one another in FIG. 2, they do not necessarily need to overlap and, together, could cover slightly less than the whole length of the shorter sides 6, 8, such as approximately two third (66%) thereof and still provide an efficient thermal break across the stud 2. Similarly, only one channel 20, 22 could be present and still provide the thermal break. It is also noted that the natural or engineered arrangement of the fibers of the wooden core tend to prevent heat conduction (or increase the heat resistance) across the stud 2 between the two longer sides 7, 9.

Although not shown herein, each channel 20, 22 could have other shapes and/or configurations without deviating from the scope of the present invention, as long as they provide the thermal break across the stud 2 between the shorter sides 6, 8. Another configuration could include an elongate slot opening or an elliptical opening extending between the two longer sides 7, 9. Also, channels 20, 22 could have the form of a plurality of typically circular openings (bores extending along the stud) aligned to each other between the two longer sides 7, 9. In all cases, all components of the stud 2, i.e. the core 4, the channels 20, 22, and the insulating material 24, 26, extend along the entire length of the stud 2.

Figure 3:
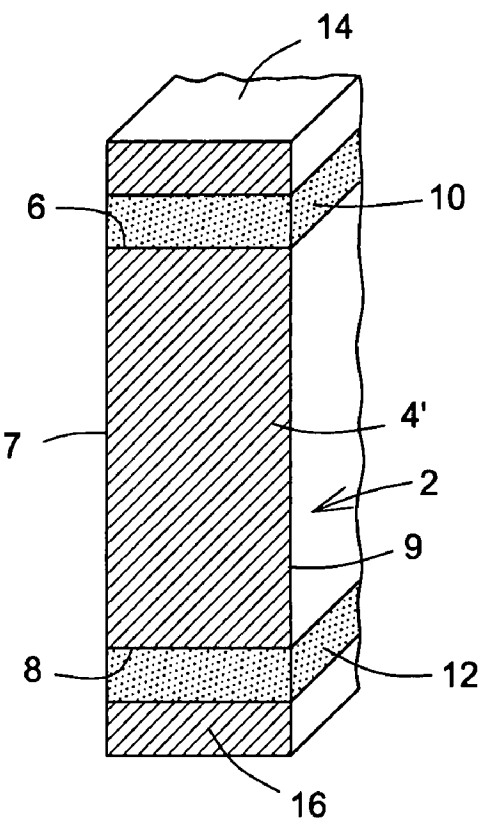
FIG. 3 is a similar view to that of FIG. 1 showing a building construction frame element according to a third embodiment of the invention.

With reference to FIG. 3, the stud 2 there shown is of similar form to that illustrated in FIG. 1 but the solid wooden core 4 is replaced by a core 4' in laminated wooden form (as highlighted by the cross-hatching), for example a plywood of suitable thickness and ply. In an alternative form of this embodiment, the wooden core is produced from a wooden composite, for example chipboard, fiberboard (MDF) or the like. As shown in FIGS. 1, 2, and 3 the layers 10, 12 are generally shorter in length than the longer sides 7, 9.

Figure 4:
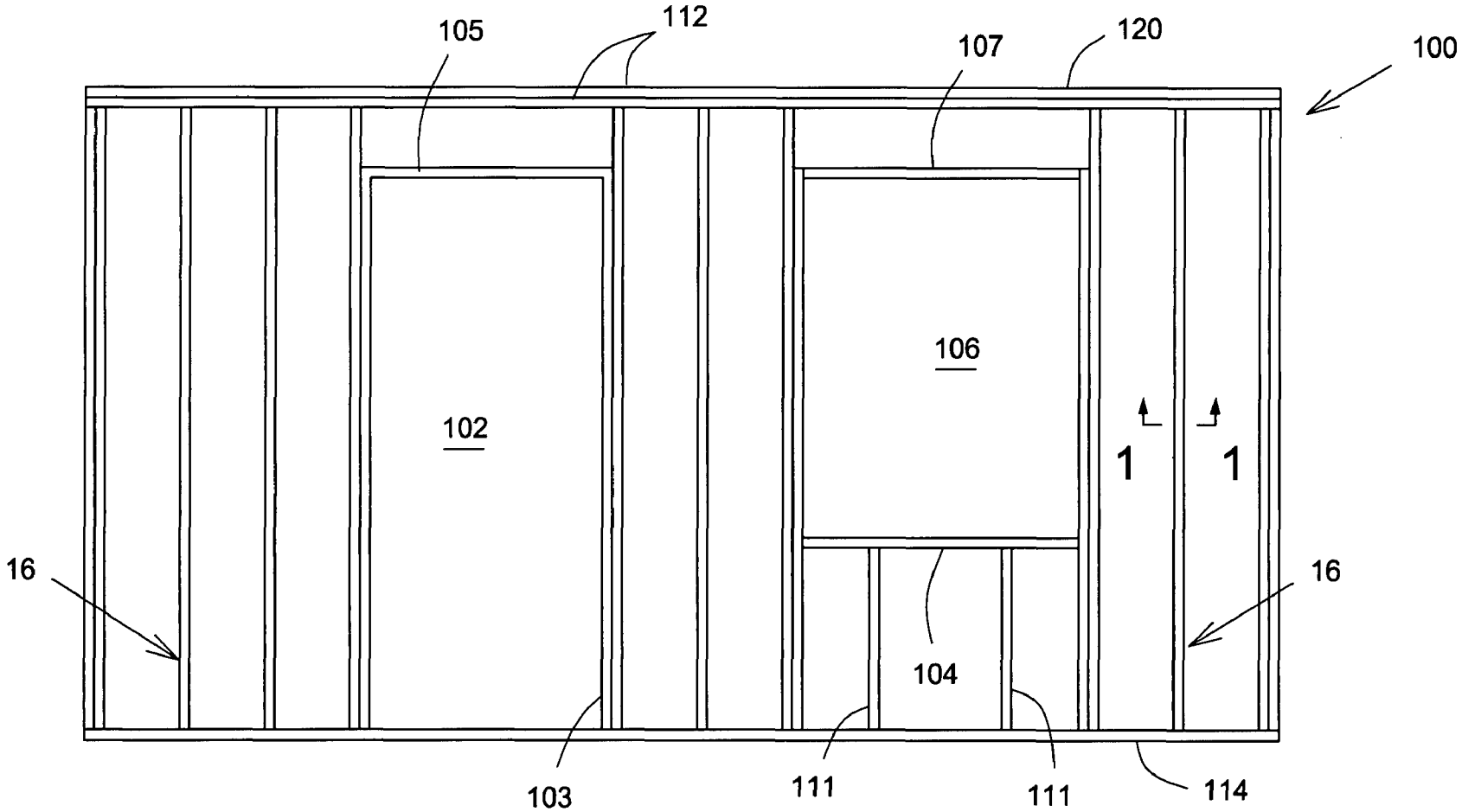
FIG. 4 is a diagrammatic front elevation of a building wall frame structure fabricated using the first embodiment of building construction frame element.

Referring now to FIG. 4 there is depicted in diagrammatic format a building wall frame structure 100 of substantially conventional design incorporating a door opening 102 and a window opening 106 in what is to become a wall 120 with plasterboard cladding (not shown). The structure 100 is provided at its relatively upper margin with double top plates 112 and its lower margin with a bottom plate 114 with a multiplicity of studs 116 extending therebetween as shown to provide the required structural stiffness and strength. The door opening 102 is provided with a jack post 103 and a lintel or header plate 105, whilst the window opening 106 is similarly formed with a lintel or header plate 107 and windowsill 109 supported by posts 111.

All the components from which the frame structure is made and which would otherwise provide a heat conductance path across the structure comprise studs of the first embodiment. The wall thus provides an improved thermal barrier in comparison with conventional structures.

The present invention thus provides an essentially wooden construction frame element with the added and important feature of an integral thermal break which prevents thermal bridging and the presence of a heat conductance path therethrough. A further advantage is that the present invention would be approved for us in building construction in territories such as Canada and the United States, since the wooden core 4, 4' includes a building code approved structural member for load-bearing walls, such as the notional two-by-four stud or an equivalent thereof.

It will be appreciated that whilst the present invention has been described with particular reference to its form as a vertical stud, it may be employed as described in alternative expressions as indicated supra namely as a lintel, window sill or the like construction frame element.

The present invention also refers to a method for producing the building construction frame element 2 having a wooden core being a single piece of wooden material, the method includes the step of:

disposing at least one thermal break across a heat conductance path of the wooden core 4.

Typically, the core 4 is a structural member of the frame element 2, such as a notional two-by-four stud. Disposing at least one thermal break across a heat conductance path of the wooden core 4 typically includes bonding at lest one layer 10, 12 of heat insulating material onto the core 4 and providing the insulating layer 10, 12 with a covering wooden lath 14, 16 thereon.

Alternatively, the wooden core 4 of a generally rectangular cross section, such as a notional two-by-six stud, has two relatively shorter sides 6, 8 and two relatively longer sides 7, 9; disposing at least one thermal break across a heat conductance path of the wooden core 4 typically includes the steps of forming a channel 20, 22 in at least one of the longer sides 7, 9 and extending the full length of the stud 2 and penetrating substantially transversely across the stud 2 to an extent that the channel 20, 22 forms a thermal break, and providing a heat insulating material in the channel 20, 22.

Although the present invention has been described with a certain degree of particularity, it is to be understood that the disclosure has been made by way of example only and is not limited to the features of the embodiments described and illustrated herein, but includes all variations and modifications within the scope and spirit of the invention as hereinafter claimed. For example, although the building construction frame element has been described as being rectangular in cross section other geometric configurations may be contemplated, e.g. square.

We claim:

1. A building construction frame element comprising a wooden core, said wooden core being a single piece of wooden material having opposite first and second ends thereof each having a rectangular cross section, said rectangular cross-section defining two relatively longer sides and two relatively shorter sides extending between the longer sides, said rectangular cross-section having at least one channel spaced apart from the shorter sides and extending from each said longer side partially across the cross section towards the other said longer side and alongside a respective said shorter side transversely through the wooden core, each channel being filled with a heat insulating material and forming therewith a thermal break providing a barrier extending across a heat conductance path of the wooden core extending longitudinally through the wooden core in a direction extending from one said shorter side to the other said shorter side and impeding passage of heat therebetween within said cross section, said heat insulating material extending from each said longer side and forming each said longer side with said wooden core, said wooden core with said heat insulating material filled in each said channel integrally forming a structural member of the frame element, said channels overlapping one another in said direction to provide the thermal break across the stud.

2. A frame element according to claim 1 wherein the frame element is a stud.

3. A frame element according to claim 1 wherein the frame element is a lintel.

4. A frame element according to claim 1 wherein the frame element is a window sill.

5. A frame element according to claim 1 wherein the wooden core is a notional stud member.

6. A frame element according to claim 5 wherein the stud member is a notional two-by-four member, the frame element substantially having dimensions of a notional two-by-six member.

7. A building wall frame structure including a plurality of structure frame members, each said frame member being a building construction frame element according to claim 1.

8. A structure according to claim 7 wherein the said plurality of structure frame members includes at least one header plate, at least one bottom plate and at least two studs assembled therebetween.

9. A method for producing a building construction frame element having a wooden core, the wooden core being a single piece of wooden material having opposite first and second ends thereof each having a rectangular cross section, said rectangular cross-section defining two relatively longer sides and two relatively shorter sides extending between the longer sides, the method comprising the steps of:

forming, in said cross section, at least one channel extending from each said longer side, and alongside a respective said shorter side and spaced apart therefrom, partially across the cross section towards the respective other said longer side, with each said channel extending from each respective said longer side overlapping one another in a direction extending from one said shorter side to the other said shorter side; and providing a heat insulating material in the channels to form a thermal break providing a barrier extending across a heat conductance path of the cross section of the wooden core extending longitudinally through the wooden core in said direction and to form, with the wooden core, a structural member of the building element.

* * * * *